US007399190B2

(12) United States Patent
Ohmori

(10) Patent No.: US 7,399,190 B2
(45) Date of Patent: Jul. 15, 2008

(54) CONNECTING DEVICE

(75) Inventor: Yasuhiro Ohmori, Yao (JP)

(73) Assignee: Hosiden Corporation, Yao-shi (JP)

( * ) Notice: Subject to any disclaimer, the term of this patent is extended or adjusted under 35 U.S.C. 154(b) by 0 days.

(21) Appl. No.: 11/730,326

(22) Filed: Mar. 30, 2007

(65) Prior Publication Data

US 2008/0057763 A1 Mar. 6, 2008

(30) Foreign Application Priority Data

Sep. 1, 2006 (JP) ..... 2006-238180

(51) Int. Cl.
*H01R 33/02* (2006.01)

(52) U.S. Cl. ..... 439/226; 439/232

(58) Field of Classification Search ..... 439/226, 439/232, 233, 239, 241, 135–140, 142, 144, 439/147

See application file for complete search history.

(56) References Cited

U.S. PATENT DOCUMENTS 5,855,487 A * 1/1999 Kunishi ..... 439/232
6,733,316 B1 * 5/2004 Chen ..... 439/232
6,890,199 B2 * 5/2005 Vogt et al. ..... 439/238
6,988,906 B1 * 1/2006 Chen ..... 439/226
7,059,888 B2 * 6/2006 Frappier et al. ..... 439/375
7,097,327 B1 * 8/2006 Barton ..... 362/260
7,168,970 B2 * 1/2007 Thiele et al. ..... 439/226
7,267,567 B1 * 9/2007 Scholeno et al. ..... 439/226
2004/0219814 A1 * 11/2004 Vogt et al. ..... 439/226
2007/0037427 A1 * 2/2007 Miyazono ..... 439/232

FOREIGN PATENT DOCUMENTS

| | | |
|---|---|---|
| EP | 0 951 108 | 10/1999 |
| FR | 2 625 376 | 6/1989 |
| JP | 6-17123 | 3/1994 |
| JP | 9-92018 | 4/1997 |
| JP | 2003-77558 | 3/2003 |

* cited by examiner

*Primary Examiner*—Ross N Gushi
(74) *Attorney, Agent, or Firm*—Kratz, Quintos & Hanson, LLP

(57) ABSTRACT

A connecting device of the invention includes a contact for electrically connecting with a lead terminal of cold cathode fluorescent lamp (electronic component), a body for accommodating the contact and having an insertion opening to allow the lead terminal to be inserted/removed from a side of the body, a shutter for opening/closing the insertion opening of the body, and an operation member mounted to the body for operating the open/close of the shutter.

10 Claims, 12 Drawing Sheets

(b)

(a)

CONNECTING DEVICE

The present application claims priority under 35 U.S.C. §119 of Japanese Patent Application No. 2006-238180 filed on Sep. 1, 2006, the disclosure of which is expressly incorporated by reference herein in its entity.

BACKGROUND OF THE INVENTION

1. Field of the Invention

The present invention relates to connecting devices for electrically connecting lead terminals of electronic components such as cold cathode fluorescent lamps.

2. Description of the Related Art

As this kind of connecting device, there is one in which a contact to be accommodated in a body includes a first connection part adapted to elastically hold a lead terminal of a cold cathode fluorescent lamp in between, and a second connection part for connection to a substrate.

For example, as a first connecting device, there is one in which a first connection part includes a fixed piece and a curved movable piece having a rectangular hole into which the fixed piece is inserted. The device is adapted such that when the movable piece is press-operated, a space is formed between a wall face of the hole and the fixed piece, so the lead terminal is inserted into the space so as to be held between them (refer to Japanese Unexamined Utility Model Publication No. 06-17123).

As a second connecting device, there is one in which a first connection part includes a fixed bracket to be mounted to an accommodation part of the body, and an almost reverse L-shaped movable piece movable vertically with respect to the top end face of the fixed bracket, and an operation member for moving the movable piece. The device is adapted such that when the movable piece is pressed by the operation member, a space is formed between the tip part of the movable piece and the top end face of the fixing bracket, so the lead terminal is inserted into the space so as to be held between them (refer to Japanese Unexamined Patent Publication No. 2003-77558).

As a third connecting device, there is one in which a contact is a coil spring to be accommodated in the body. The device is adapted such that the coil spring is to be compressed to form a space between one end part of the coil spring and an inner wall of the body, so the lead terminal is inserted into the space so as to be held between them (Japanese Unexamined Patent Publication No. 09-92018).

SUMMARY OF THE INVENTION

Such a connecting device as mentioned above is hoped to allow the insertion/removal of a lead terminal from its side, at the request for easy insertion/removal of the lead terminal and prevention of breakage of the lead terminal or the entire cold cathode fluorescent lamp during mounting. To adapt the connecting device to allow insertion/removal of the lead terminal from its side, it is necessary to form an insertion opening to insert/remove the lead terminal in the top face of the body. Such an insertion opening in the top face of the body may easily allow invasion of dust, causing a problem such as contact failure of the contact and short circuit.

The present invention has been made in view of the above situation to provide a connecting device that has an insertion opening for insertion and removal of a lead terminal from its side but still can prevent invasion of dust through the insertion opening.

In order to solve the problem discussed above, a connecting device of the present invention includes a body having an insertion opening for removably receiving a lead terminal from a side thereof, a contact to be accommodated inside the body, the contact being contactable with the lead terminal inserted through the insertion opening and a shutter provided with the body so as to openably close the insertion opening.

Particularly, since the insertion opening can be closed with the shutter, invasion of dust can be prevented.

The connecting device may be so configured as to further include an operation member that is a member for operation to move at least the shutter and is mounted on the body movably in an insertion/removal direction of the lead terminal.

In such a case, the connecting device may be so configured that the body is provided with a mounting hole, or a long hole extending in a direction almost orthogonal to the insertion/removal direction of the lead terminal and penetrating the body, the operation member has a guide groove in a face thereof facing the body, the guide groove being formed to obliquely cross the mounting hole and fit the shutter thereinto through the mounting hole, and the shutter is adapted to move from one end portion of the guide groove to the other end portion of the guide groove in accordance with a movement of the operation member to thereby move in the mounting hole from an opening position to open the insertion opening to a closing position to close the insertion opening.

Namely, when the operation member is operated, the shutter moves obliquely from one end of the guide groove to the other end of the guide groove, whereby the shutter moves in the mounting hole, from the opening position to open the insertion opening to the closing position to close the insertion opening.

The contact may include a first connection part for connection with a lead terminal, and a second connection part for connection with a substrate. The first connection part may include first and second clamp arms which are elastically deformable. In such a case, the first and second clamp arms include first and second bent or curved parts which are bent or curved in directions away from each other, and first and second hold parts which are continued from tip portions of the first and second bent or curved parts, and are bent or curved in directions opposite to the first and second bent or curved parts. Further, a face of the body facing the operating member may have an opening facing the first and second bent or curved parts, and the operation member may have a pair of piece members to be inserted in the opening movably in the insertion/removal direction. The pair of piece members are adapted to press the first and second bent or curved parts in directions approaching each other when the shutter is positioned at the opening position, and to release the pressing of the first and second bent or curved parts when the shutter is positioned at the closing position. Accordingly, when the first and second bent or curved parts are pressed by the pair of piece members, the first and second hold parts move in directions approaching each other and cross each other so as to form a space for receiving the lead terminal between the first and second hold parts, and when the pressing by the pair of piece members is released, the first and second hold parts move in directions approaching each other and close the space so as to hold the lead terminal between the first and second hold parts.

By simply operating the operation member as described above, open/close of the shutter and open/close of the space between the first and second hold parts of the first and second clamp arms of the contact can be performed at the same time. Therefore, the shutter will not hinder the insertion of the lead terminal into the insertion opening, and there is no need to perform an operation to open/close the shutter separately from the operation to open/close of the space between the first and second hold parts. Therefore, even though a shutter is provided to keep dust out of the device, it is possible to connect the lead terminal with the contact easily. Further, elastic forces of the first and second clamp arms are only used for holding the lead terminal, so the elastic forces of the clamp arms will not directly act on the body. Moreover, since it is only necessary to insert the lead terminal into the space formed between the first and second hold parts, unlike the third connecting device as described above as a conventional art, it is not needed to form a space for inserting the lead terminal by pressing the contact which is a coil spring with the lead terminal. Therefore, the lead terminal or the electronic components of the invention will not be damaged by the pressing.

Alternatively, the first connection part may include a first clamp arm which is a fixed piece and a second clamp arm which is an elastically deformable movable piece. In such a case, the second clamp arm may include a bent part or a curved part which is bent or curved in a direction away from the first clamp arm, and a hold part which is continued from the tip part of the bent part or the curved part and is bent or curved in a direction opposite to the bent part or the curved part. Further, the face of the body facing the operating member may have an opening facing the bent part or the curved part. The operation member may have a piece member to be inserted in the opening movably in the insertion/removal direction. The of piece member is adapted to press the bent part or the curved part in a direction toward the first clamp arm when the shutter is positioned at the opening position, and to release the pressing of the bent part or the curved part when the shutter is positioned at the closing position. Accordingly, when the bent part or the curved part is pressed by the piece member, the hold part moves in a direction approaching the first clamp arm and crosses the first clamp arm so as to form a space for receiving the lead terminal between them, and when the pressing by the piece member is released, the hold part moves in a direction approaching the first clamp arm and thereby close the space so as to hold the lead terminal between the hold part of the second clamp arm and the first clamp arm.

By simply operating the operation member as described above, open/close of the shutter and open/close of the space between the hold part of the second clamp arm and the first clamp arm of the contact can be performed at the same time. Therefore, the shutter will not hinder the insertion of the lead terminal into the insertion opening, and there is no need to perform an operation to open/close the shutter separately from open/close between the hold part of the second clamp arm and the first clamp arm. Therefore, even though a shutter is provided to keep dust out of the device, it is possible to connect the lead terminal with the contact easily. Further, elastic force of the second clamp arm is only used for holding the lead terminal, so a load due to the elastic force of the second clamp arm will not directly act on the body. Moreover, since it is only necessary to insert the lead terminal into the space formed between the hold part of the second clamp arm and the first clamp arm, unlike the third connecting device as described above as a conventional art, it is not needed to form a space for inserting the lead terminal by pressing the contact which is a coil spring with the lead terminal. Therefore, the lead terminal or the electronic components of the invention will not be damaged by the pressing.

If the contact has two first clamp arms, the two first clamp arms may be provided on the both sides of the second clamp arm. Alternatively, if the contact has two second clamp arms, the two second clamp arms may be provided on the both sides of the first clamp arm.

The lead terminal can be held stably because it is held at three points, that is, with two first clamp arms and one second clamp arm, or with two second clamp arms and one first clamp arm.

The body may include an open part for protruding the second connection part of the contact so as to be contactable with a circuit pattern of the substrate, and an engaging claw which is provided on an edge part of the open part and extends in a protruding direction of the second connection part for engagement with the substrate.

In such a case, when the engaging claw is engaged with the substrate, the second connection part of the contact contacts the circuit pattern of the substrate to provide electrical connection. Therefore, it is easy to electrically connect the contact with the substrate.

For stable electrical connection of the contact, it is preferable that the second connection part of the contact be in a shape to allow elastic contact with the circuit pattern of the substrate.

If a through hole is formed in the substrate, the second connection part of the contact may be a portion in a substantially linear shape to allow insertion into the through hole of the substrate. Alternatively, the second connection part of the contact may be in such a shape that a lead wire can be press-connected with the second connection part so that the contact may contact the substrate via the lead wire.

According to the connecting device of the present invention, even if an insertion opening enabling a lead terminal to be inserted/removed from a side face thereof is provided in the body, it is possible to prevent invasion of dust from the insertion opening with a shutter. Therefore, a connection failure of a contact or short circuit in the body can be prevented.

NUMERICAL REFERENCES

Figure 1:
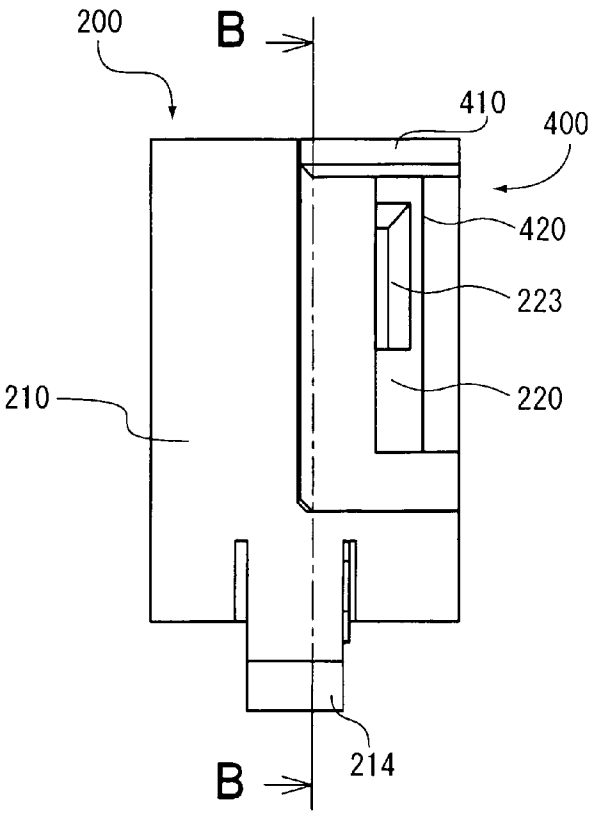
FIG. 1 is a diagram showing a connecting device according to an embodiment of the present invention, in which (a) is a front view, and (b) is a side view.
Figure 1:
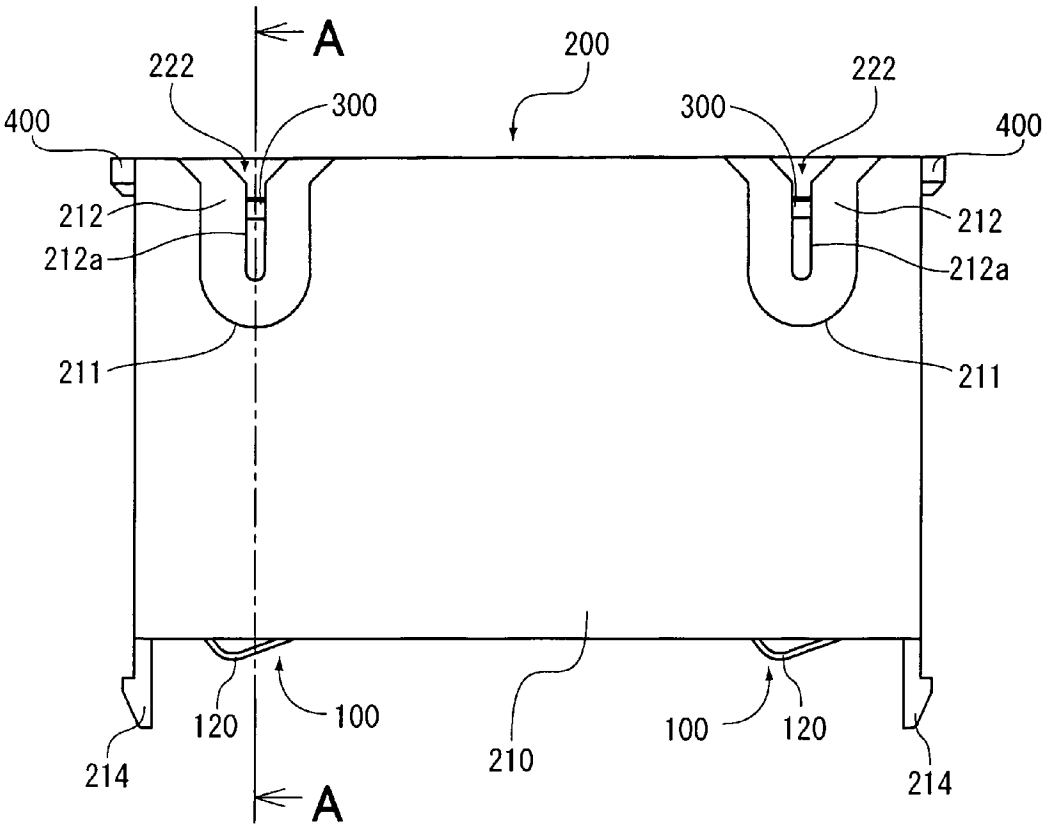

100 contact
110 first connection part
111 first clamp arm
111*a* first bent part
111*b* first hold part
112 second clamp arm
112*a* second bent part
112*b* second hold part
120 second connection part
200 body
224 mounting hole
300 shutter
400 operation member
440 guide groove
α space

DETAILED DESCRIPTION OF THE PREFERRED EMBODIMENT

Hereinafter, a connecting device according to an embodiment of the present invention will be described with reference to the drawings.

An embodiment of a connecting device is a socket for a cold cathode fluorescent lamp 10. The socket includes two contacts 100 for electrically connecting a lead terminal 12 of the cold cathode fluorescent lamp (electronic component) 10 and a substrate 20, a body 200 accommodating the two contacts 100 and having a pair of insertion openings 222 to allow insertion/removal of the lead terminal 12 through a side face thereof, a pair of shutters 300 to openably close the pair of insertion openings 222 of the body 200, and a pair of operation members 400 mounted on the body 200 to operate the opening and closing of the pair of shutters 300. Hereinafter, detailed description of the connecting device will be given.

Figure 3:
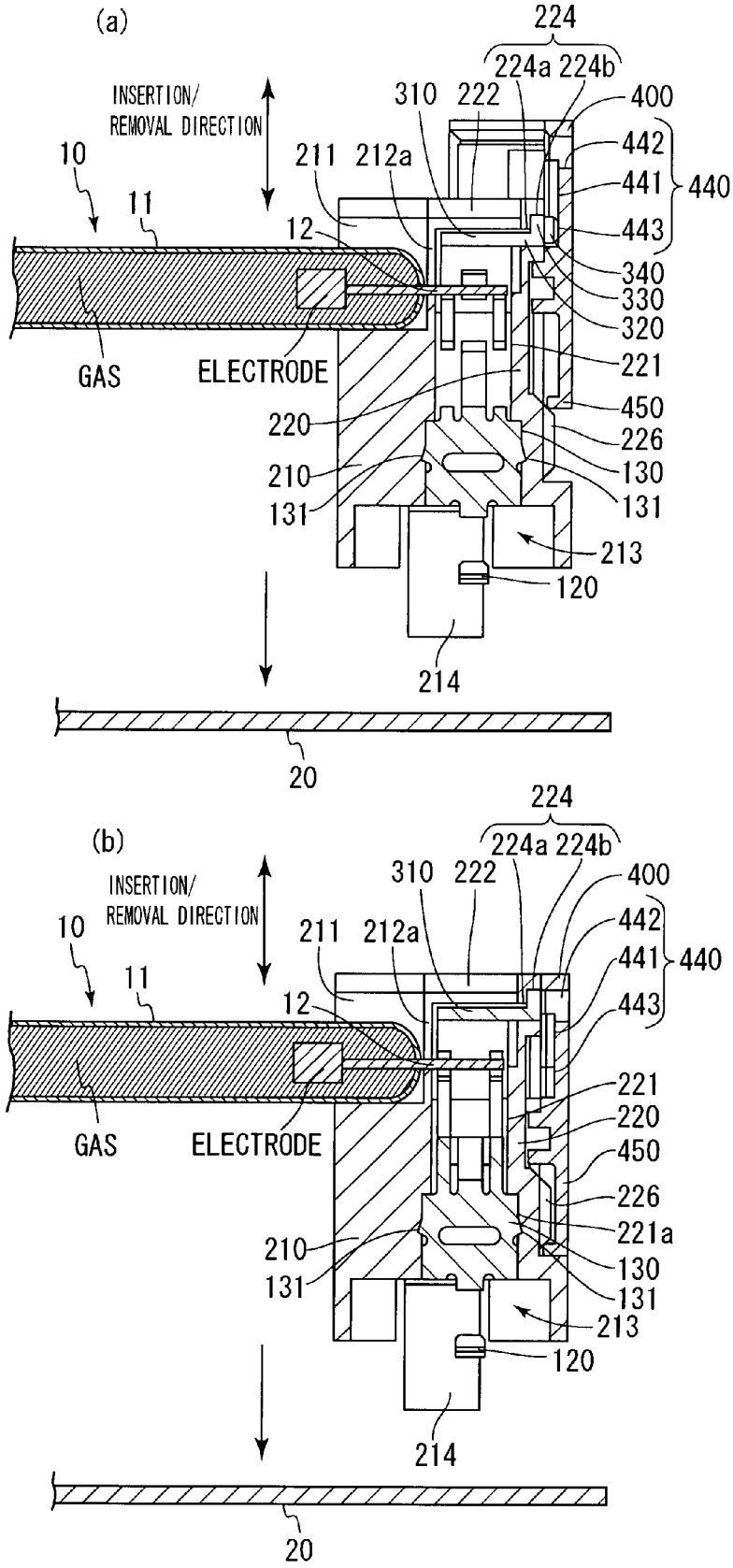
FIG. 3 is an A-A sectional view of the device, in which (a) is a diagram showing a state after the operation member is slide-moved, and (b) is a diagram showing a state where a lead terminal of an electronic component is inserted.

As shown in FIG. 3, the cold cathode fluorescent lamp 10 includes a lamp part 11 and the lead terminal 12 protruded from the lamp part 11.

As shown in FIGS. 1 to 4, the body 200 includes a main body part 210 in an almost L shape when viewed from a side, and two guide parts 220 in an almost rectangular shape provided on opposite end parts of the rear face of a thin part of the main body part 210.

Figure 4:
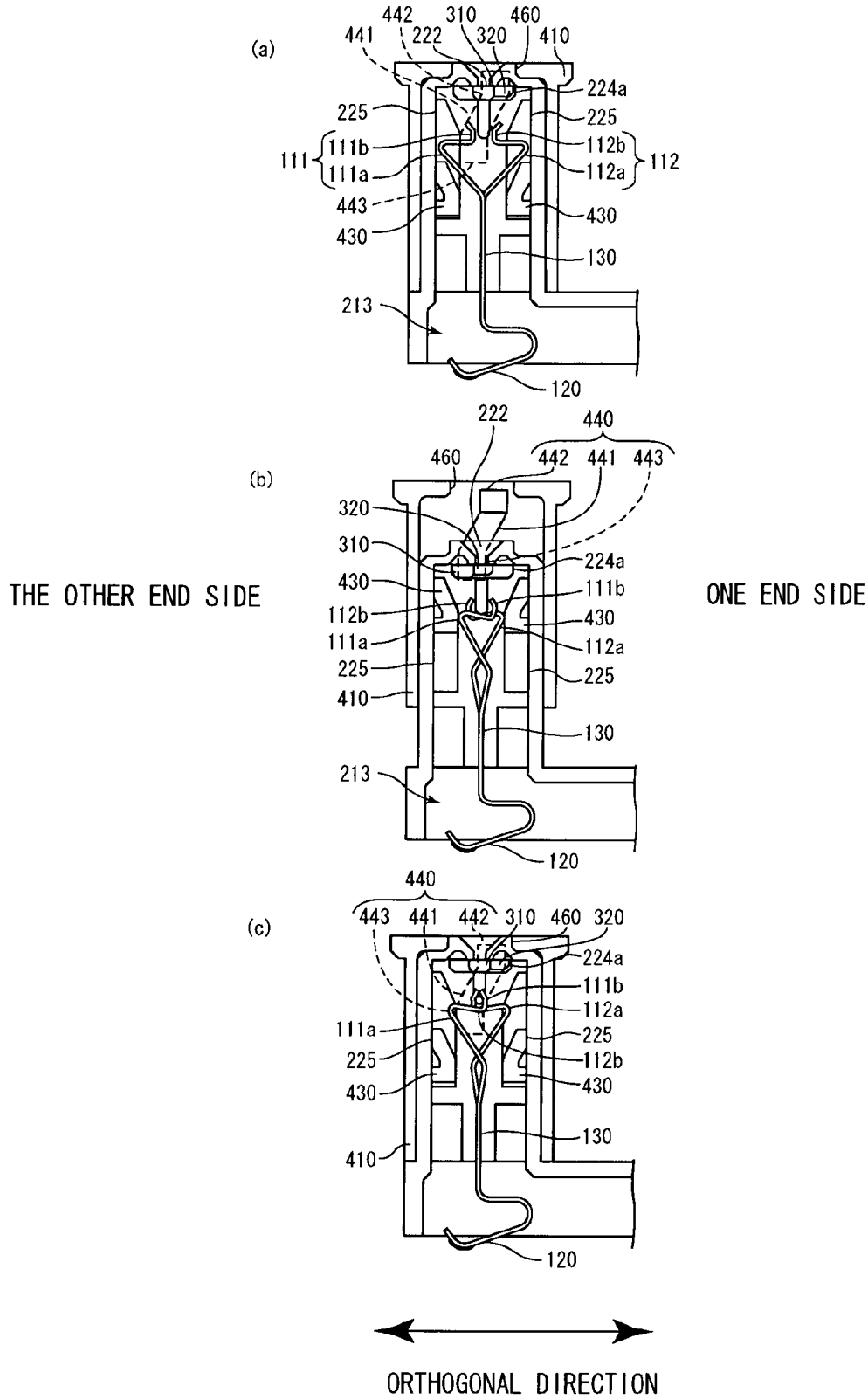
FIG. 4 is a B-B sectional view of FIG. 1 of the device, in which (a) is a diagram showing a state before the operation member is slide-moved, (b) is a diagram showing a state after the operation member is slide-moved, and (c) is a diagram showing a state that the lead terminal of the electronic component is inserted.
Figure 5:
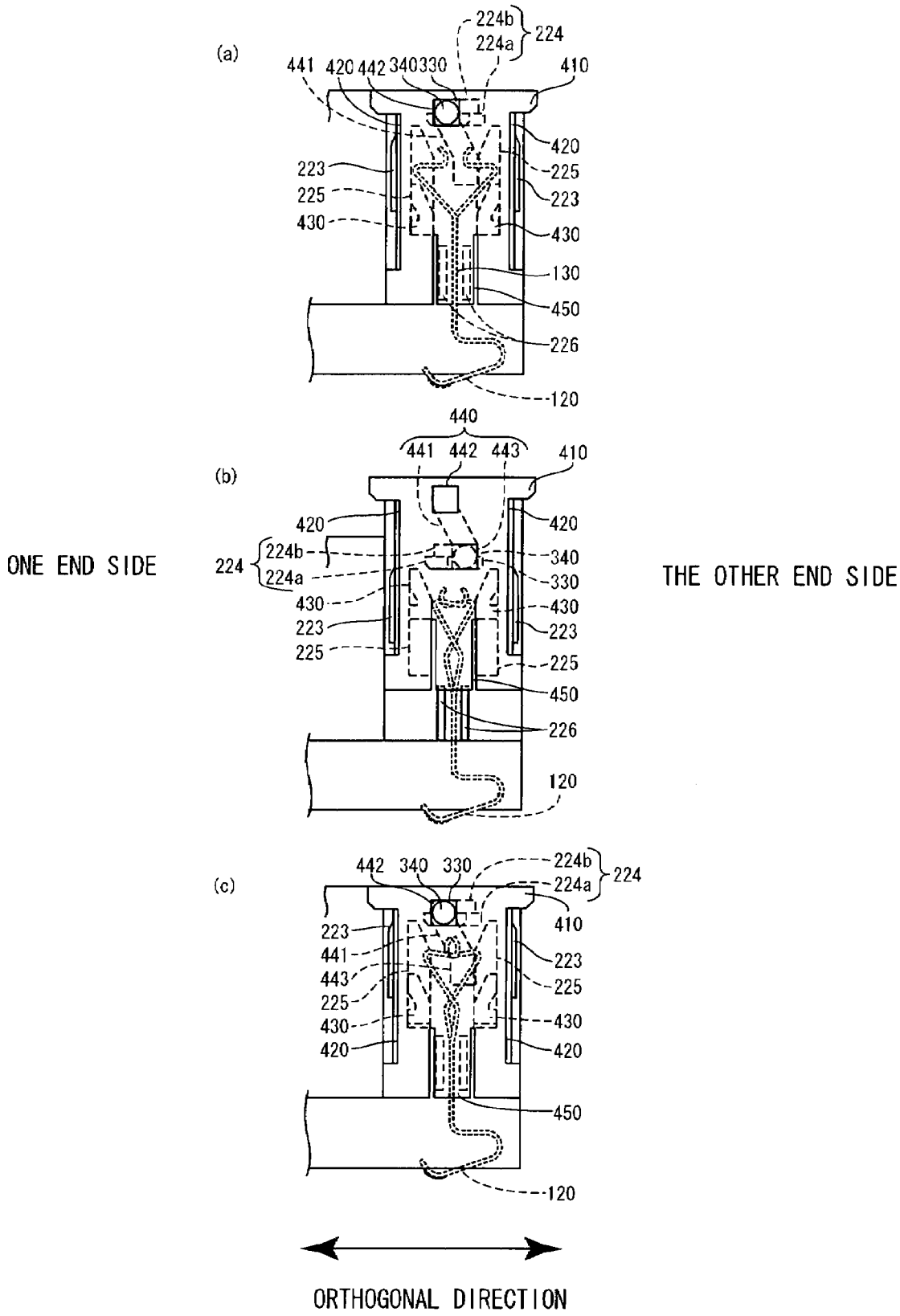
FIG. 5 is a schematic rear view of an end part of the device, transparently showing an operation member, in which (a) shows a state before the operation member is slide-moved, (b) shows a state after the operation member is slide-moved, and (c) shows a state that the lead terminal of the electronic component is inserted.

Inside each of the guide parts 220, there is provided an accommodation part 221 for accommodating the contact 100 as shown in FIGS. 3, 4 and 5. The accommodation part 221, a substantially rectangular parallelepiped space, communicates with an open part 213 in the lower end part of the main body part 210. In the lower end part of the accommodation part 221, there is provided a press-fitting part 221*a* that is slightly wider than the other parts of the accommodation part 221. The width dimension of the press-fitting part 221*a* is almost the same as that of an intermediate part 130 of a contact 100 so that the intermediate part 130 may be press-fitted into the press-fitting part 221*a*.

The guide part 220 is provided centrally of its top with a protrusion, in which the insertion opening 222 is formed. The insertion opening 222 is a hole communicating with the accommodation part 211, and the width dimension thereof is set to be slightly larger than the width dimension of the lead terminal 12 of the cold cathode fluorescent lamp 10. The widthwise edges of the insertion opening 222 are tapered for guiding the lead terminal 12 into the insertion opening 222.

Figure 2:
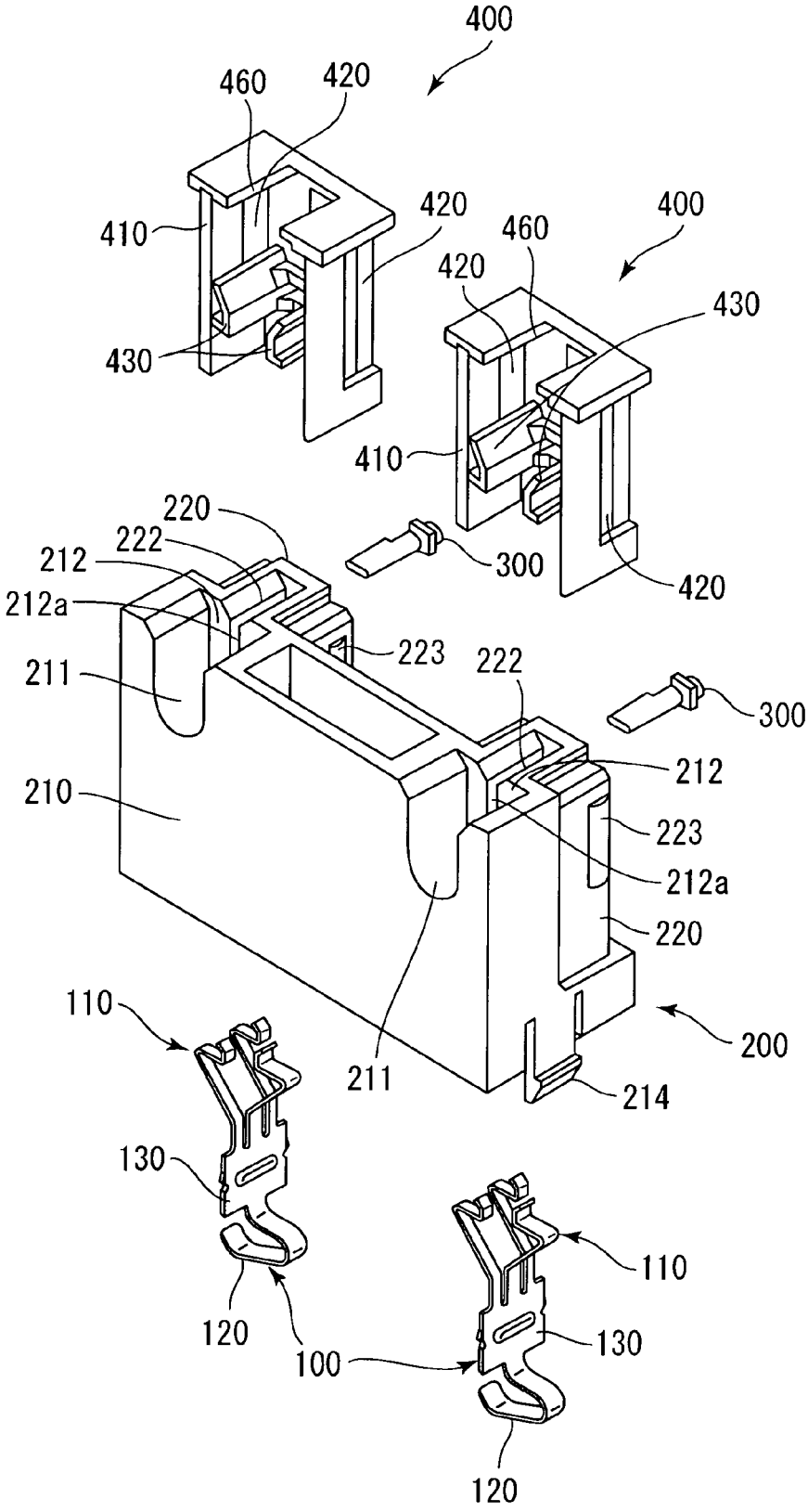
FIG. 2 is a schematic exploded perspective view of the device.

Further, as shown in FIGS. 1, 2 and 5, the both widthwise end faces of the guide part 220 are provided with a pair of guide protrusions 223 for guiding the operation member 400 movably in an insertion/removal direction of the lead terminal 12 (hereinafter called "the insertion/removal direction").

As shown in FIG. 3, the guide part 220 has a mounting hole 224 for receiving the shutter 300 movably in a direction orthogonal (hereinafter called "the orthogonal direction") to the insertion/removal direction. The mounting hole 224 is located below the insertion opening 222 on a wall in a thickness direction (that is, the surface facing the operation member) of the guide part 220. Further, the both end parts of the wall of the guide part 220 are provided with a pair of openings 225 into which a pair of piece members 430 of the operation member 400 are inserted. Further, toward the lower center of the wall of the guide part 220, there is provided a pair of engaging protrusion parts 226 for engagement with the operation member 400.

The openings 225 are long holes extending in the insertion/removal direction and facing first and second bent parts 111*a* and 112*a* of the contact 100 accommodated in the accommodation part 221. As shown in FIGS. 3 and 4, the insides of the openings 225 are inclined toward the top to conform to the shapes of the piece members 430 of the operation member 400.

As shown in FIGS. 3 and 4, the mounting hole 224 comprises a main body hole part 224*a* and a guide dented part 224*b*. The main body hole part 224*a*, being a long hole, opens into the face of the guide part 220 facing the operation member and extends in the orthogonal direction. The guide dented part 224*b* communicates with the top of the main body hole part 224*a* and is narrower than the main body hole part 224*a*.

The main body hole part 224*a* is adapted to receive a first runner part 320 of the shutter 300 and guides the first runner part 320 movably in the orthogonal direction. On the other hand, the guide dented part 224*b* guides a second runner part 330 of the shutter 300 in moving in the orthogonal direction.

The main body part 210 is provided at opposite ends of the upper face thereof with a pair of accommodation grooves 211 communicating with a pair of insertion openings 222, and a pair of wall parts 212 parting the pair of accommodation grooves 211 and the pair of insertion openings 222.

Each of the wall parts 212 has a slit 212*a* continuing to the insertion opening 222 and extending along the insertion/removal direction.

The slit 212*a* is so formed that the width dimension thereof is slightly larger than the width dimension of the lead terminal 12 of the cold cathode fluorescent lamp 10 so as to removably receive the lead terminal 12. The widthwise edges of the slit 212*a* are provided with tapered faces for guiding the lead terminal 12, continued from the tapered faces on the edges of the insertion opening 222 of the guide part 220. Further, the depth dimension of the slit 212*a* is set to a depth up to a position almost the same as the position where the lead terminal 12 is held between first and second clamp arms 111 and 112 of the contact 100 in the accommodation part 221. In other words, it is so configured that the lead terminal 12 is held between the first and second clamp arms 111 and 112 of the contact 100 in the accommodation part 221 and is also supported on the bottom of the slit 212*a*.

Each of the accommodation grooves 211 is an almost U-shaped groove, whose width dimension is set to be slightly larger than the lamp part 11 of the cold cathode fluorescent lamp 10, enabling the lamp part 11 to be inserted/removed from the side of the groove 211. The widthwise edges of the accommodation groove 211 are provided with tapered faces for guiding the lamp part 11. The depth dimension of the accommodation groove 211 is set to such a depth that the lamp part 11 of the cold cathode fluorescent lamp 10 is mounted on the bottom of the accommodation groove 211 in a state where the lead terminal 12 of the cold cathode fluorescent lamp 10 is supported on the bottom of the slit 212*a* of the wall part 212.

As shown in FIGS. 3 and 4, the lower end part of the main body part 210 is provided with an open part 213 communicating with the press-fitting parts 221*a* of the accommodation parts 221. The open part 213 is a hole for downwardly protruding the second connection parts 120 of the contacts 100 accommodated in the accommodation parts 221. On the outside edges of the open part 213, engaging claws 214 for engaging with engaging holes, not shown, of the substrate 20, are provided in a downward direction (that is, the same direction as the protruding direction of the second connection parts 120 of the contacts 100).

Figure 6:
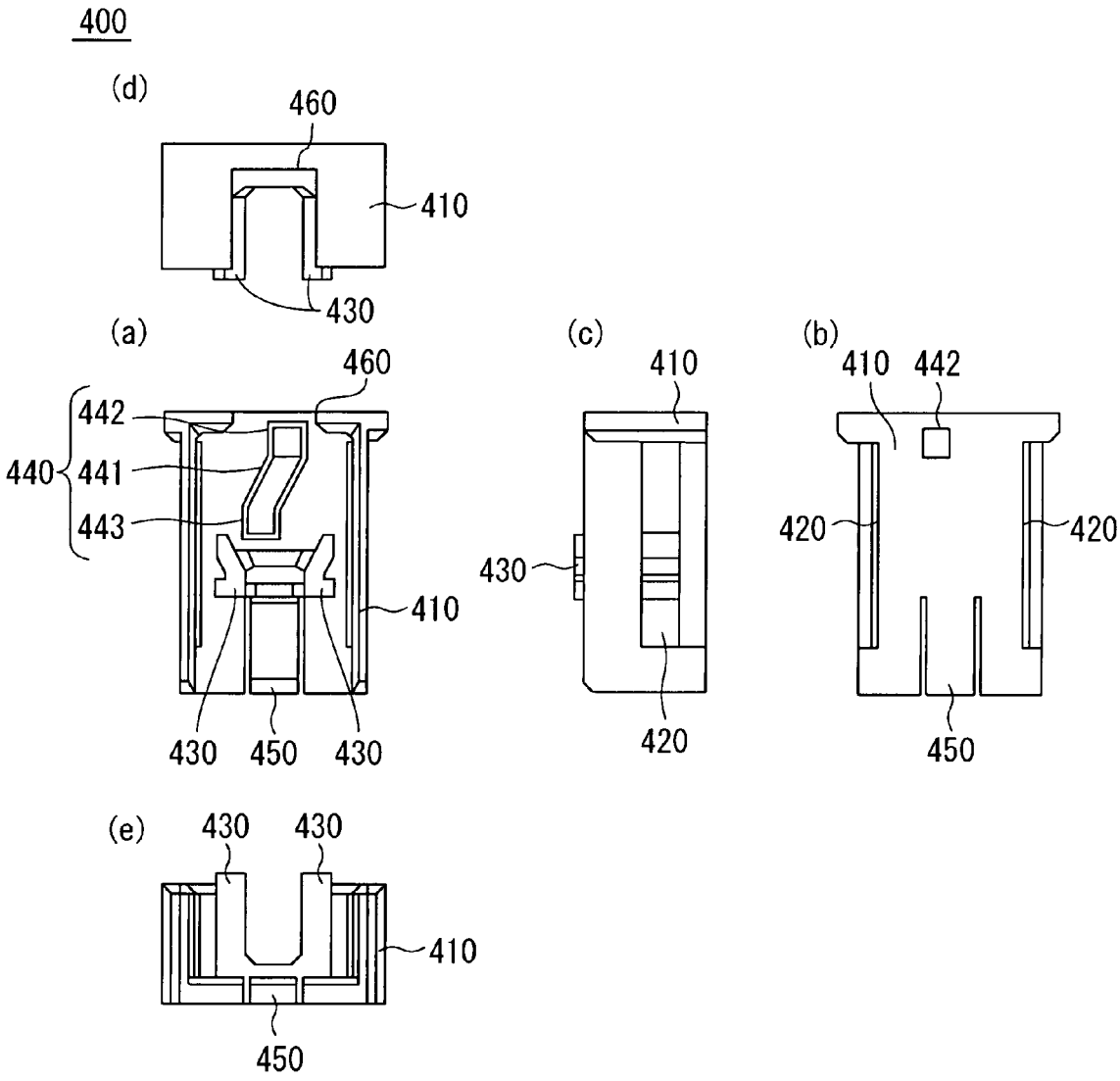
FIG. 6 is a diagram showing the operation member of the device, in which (a) is a schematic front view, (b) is a schematic rear view, (c) is a schematic side view, (d) is a schematic front view, and (e) is a schematic bottom view.
Figure 7:
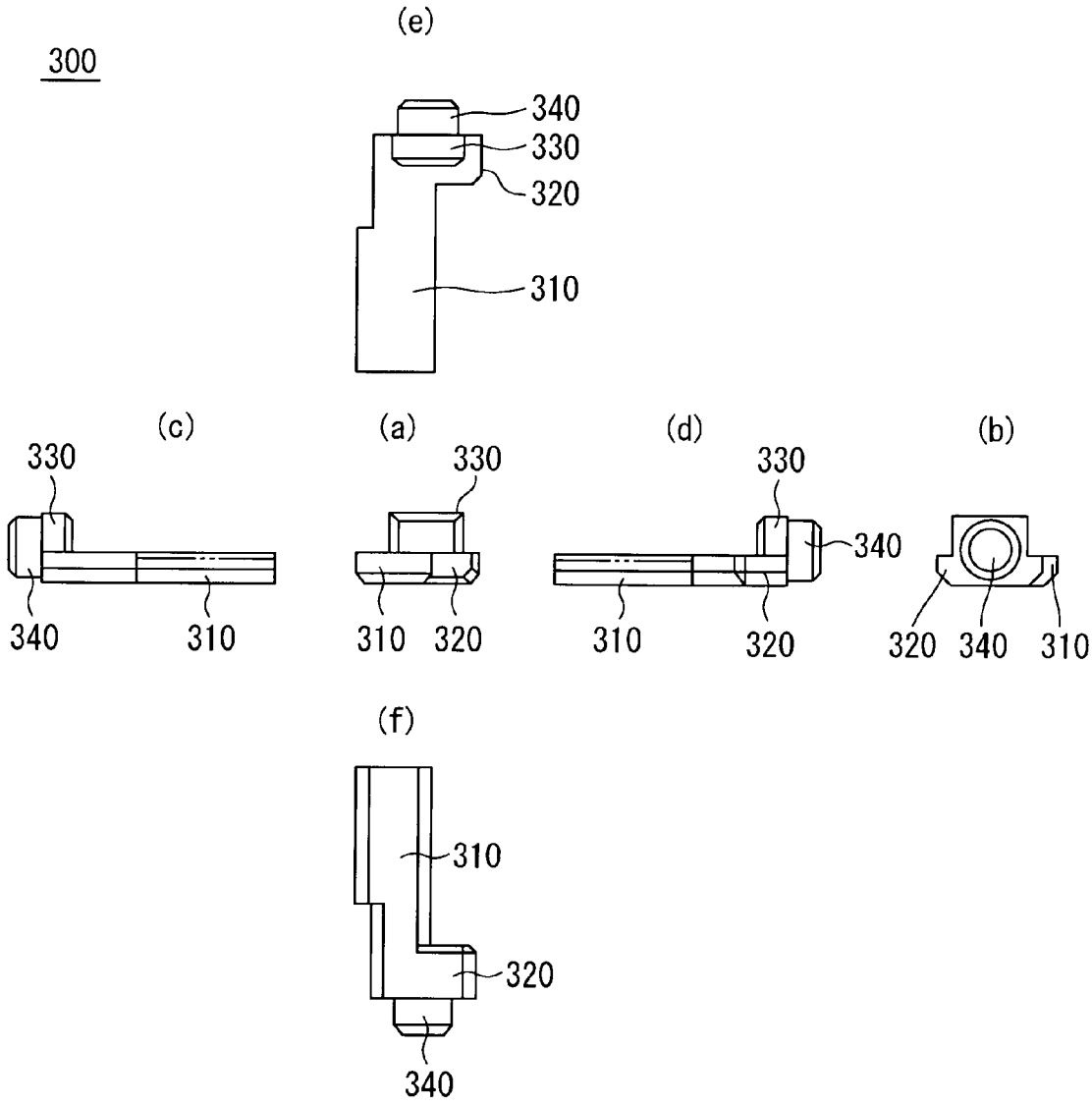
FIG. 7 is a diagram showing a shutter of the device, in which (a) is a schematic front view, (b) is a schematic rear view, (c) is a schematic left-side view, (d) is a schematic right-side view, (e) is a schematic plan view, and (f) is a schematic bottom view.
Figure 8:
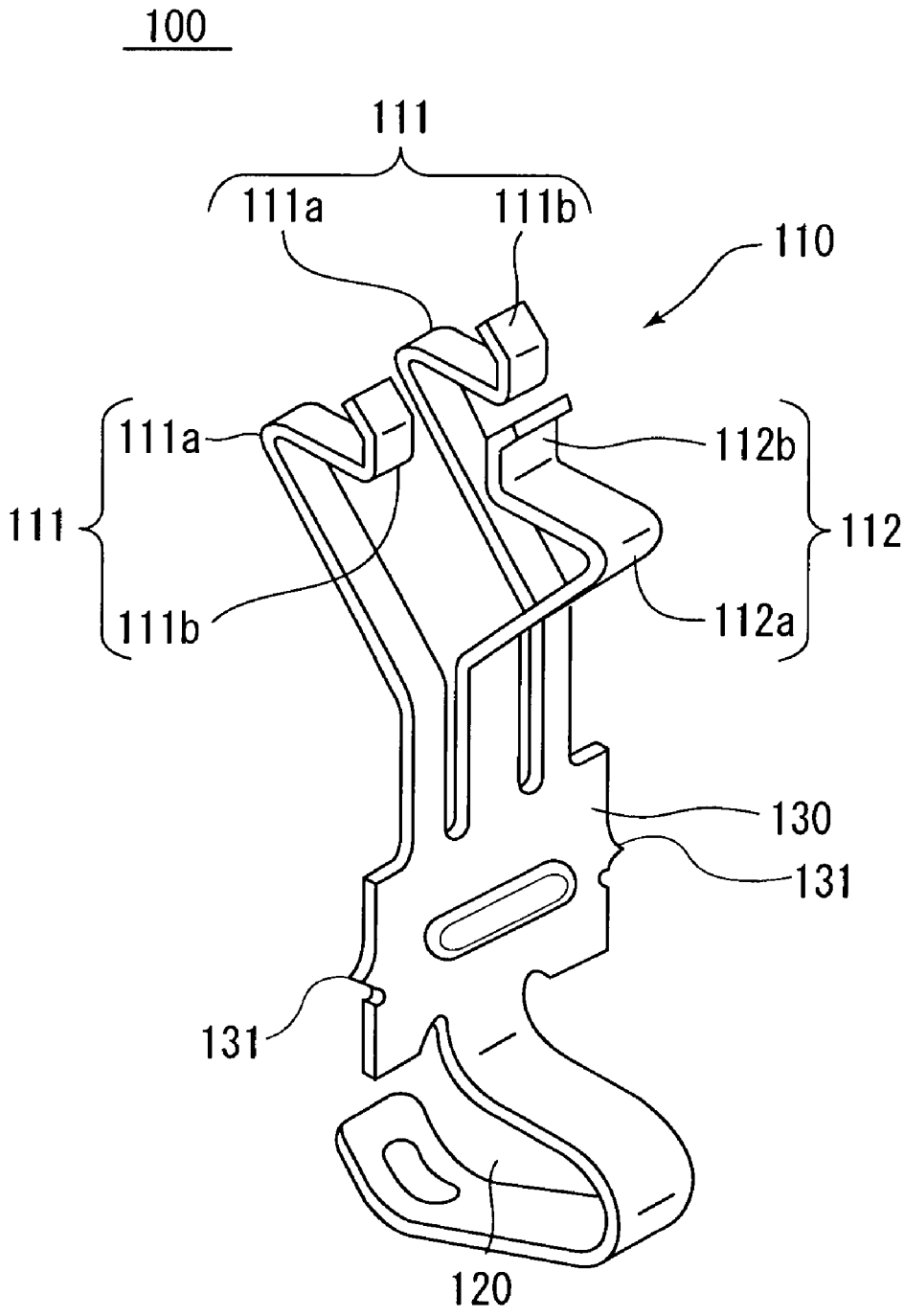
FIG. 8 is a schematic perspective view of a contact of the device.

As shown in FIGS. 2 and 6, each of the operation members 400 has a movable main body part 410, in an almost rectangular box shape, in which the back face and the lower face are opened, a pair of rail grooves 420 formed by cutting away the corners of the opposite widthwise end parts of the movable main body part 410, a pair of piece members 430 provided between the pair of rail grooves 420 on the inner face of the movable main body part 410, a guide groove 440 provided on the upper side position between the pair of piece members 430 on an inner face of the movable main body part 410, an engaging piece 450 provided at the lower end of the movable main body part 410, and a notch 460 for exposing the protruding part on the top of the guide part 220.

In the rail grooves 420, the guide protrusions 223 of the guide part 220 are fitted. Thereby, the movable main body part 410 is mounted on the guide part 220 so as to be slidable from the "initial position" (that is, a position that the guide protrusion 223 is positioned at the top of the rail groove 420) shown in FIGS. 4(*a*) and 4(*c*) to the "pressed position" (that is, a position that the guide protrusion 223 is positioned at the bottom of the rail groove 420) shown in FIG. 4(*b*). When the movable main body part 410 is positioned at the initial position, the opposite edges of the notch 460 of the movable main body part 410 contact the opposite sides of the protruding part on the top of the guide part 220. Thereby, the movable main body part 410 is positionally restricted at the initial position. On the other hand, when the movable main body part 410 is positioned at the pressed position, the tapered faces at the top ends of the pair of piece members 430 contact the inclined faces of the top end part of the openings 225 of the guide part 220. Thereby, the movable main body part 410 is positionally restricted at the pressed position.

As shown in FIG. 3, the engaging piece 450 is so formed that the lower end part is protruding toward the guide part 220. When the movable main body part 410 is positioned at the initial position, the protrusion is engaged with and stopped by the pair of engaging protruding parts 226 of the guide part 220.

The top end parts of the pair of piece members 430 form tapered faces, the spacing between which decreases gradually. The pair of piece members 430 are inserted in the pair of openings 225 movably in the insertion/removal direction. When the movable main body part 410 is positioned at the pressed position, one of the piece members 430 presses the two first bent parts 111*a* of the two first clamp arms 111 of the contact 100 inside the accommodation part 221, while the other piece member 430 presses the second bent part 112*a* of the second clamp arm 112 of the same contact 100. When the movable main body part 410 is positioned at the initial position, the one piece member 430 releases the pressing of the two first bent parts 111*a* of the two first clamp arms 111, while the other piece member 430 releases the pressing of the second bent part 112*a* of the second clamp arm 112

As shown in FIGS. 4 and 5, each of the guide grooves 440 includes an inclined groove part 441 obliquely crossed with respect to the mounting hole 224 of the guide part 220, a rectangular hole part 442 continuing to the upper end of the inclined groove part 441 (that is, being provided at the other end part of the guide groove 440), and a rectangular dented part 443 continuing to the lower end of the inclined groove part 441 (that is, being provided at one end part of the guide groove 440).

The hole part 442 is provided at a position slightly shifted to one end side in the aforementioned orthogonal direction from the position opposing the insertion opening 222 of the guide part 220 when the movable main body part 410 is positioned at the initial position. The hole part 442 is a through hole and serves as a sight hole for checking the position of a third runner part 340 of the shutter 300. The dented part 443 is provided at a position slightly shifted to the other end side in the aforementioned orthogonal direction from the position opposite to the insertion opening 222 of the guide part 220 when the movable main body part 410 is positioned at the pressed position. The inclined groove part 441 is a groove for guiding the third runner part 340 of the shutter 300 from the hole part 442 to the dented part 443.

As shown in FIGS. 2 to 7, the shutter 300 includes: a shutter main body 310, in a plate shape, for opening and closing the insertion opening 222 of the guide part 220; a first runner part 320, in a plate shape, arranged perpendicular to the shutter main body 310; a second runner part 330, in a protruding shape, provided on the first the runner part 320; and the third runner part 340, in a columnar shape, provided on one end faces of the first and second runner parts 320 and 330.

The shutter main body 310 is arranged eccentrically with respect to the first runner part 320. The first runner part 320 is movably fitted in the main body hole part 224*a* of the guide part 220. The second runner part 330 is movably fitted in the guide dented part 224*b* of the guide part 220. The third runner part 340 is movably fitted in the guide groove 440 of the operation member 400.

Namely, when the third runner part 340 is positioned at the hole part 442 of the guide groove 440, the first and second runner parts 320 and 330 are positioned at one end parts of the main body hole part 224*a* and the guide dented part 224*b*, respectively, of the guide part 220, and the shutter main body 310 is positioned at a "closing position" to close the insertion opening 222 of the guide part 220. On the other hand, when the third runner part 340 is positioned at the dented part 443 of the guide groove 440, the first and second runner parts 320 and 330 are positioned at the other end parts of the main body hole part 224*a* and the guide dented part 224*b*, respectively, of the guide part 220, and the shutter main body 310 is positioned at an "opening position" to open the insertion opening 222 of the guide part 220.

As shown in FIGS. 2, 3, 4, 5 and 8, each of the contacts 100 is a plate spring having conductivity and includes a first connection part 110 for connection to a lead terminal, a second connection part 120 for connection to a substrate, and an intermediate part 130 positioned between the first and second connection parts 110 and 120.

The intermediate part 130 is a rectangular plate-shaped body, and the width dimension thereof is almost the same as the width dimension of the press-fitting part 221*a* of the accommodation part 211 of the body 200. The opposite end parts of the intermediate part 130 are provided with a pair of engaging protrusions 131. When the pair of engaging protrusions 131 is press-fitted in the press-fitting part 221*a* of the accommodation part 221, the contact 100 is held inside the accommodation part 221.

The second connection part 120 is continued from the lower end of the intermediate part 130 and curved in an almost U shape. As shown in FIG. 3, the height dimension of the second connection part 120 is so set as to protrude from the open part 213 of the body 200 in a state where the intermediate part 130 is held inside the accommodation part 221 of the body 200.

The first connection part 110 has two first clamp arms 111, being elastically deformable and provided on the top end of the intermediate part 130 with a spacing between the two, and a second clamp arm 112, being elastically deformable and disposed between the two first clamp arms 111 on the top end of the intermediate part 130.

Each of the first clamp arm 111 has a first bent part 111*a* in an almost L shape, and a first hold part 111*b* which is continued from the tip of the first bent part 111*a* and bent in a direction opposite to the first bent part 111*a*.

The second clamp arm 112 has a second bent part 112*a* in an almost inverse L shape (that is, bent in a direction opposite to the first bent part 111*a*), and a second hold part 112*b* which is continued from the tip of the second bent part 112*a* and bent in a direction opposite to the second bent part 112*a*.

The two first bent parts 111*a* and the second bent part 112*a* are bent in such a manner that their straight parts at the top are almost parallel to the substrate 20. The length dimensions of the straight parts are such that the two first bent parts and the second bent part will not intersect with each other in the initial state, and when the two first bent parts 111*a* and the second bent part 112*a* are pressed by the piece members 430 of the operation member 400, the two first bent parts 111*a* and the second bent part 112*a* intersect with each other so as to form a space α for receiving the lead terminal 12 between the two first hold parts 111*b* and the second hold part 112*b*.

Hereinafter, description will be made of the assembling procedures of the connecting device having the above configuration. First, the intermediate parts 130 of contacts 100 are aligned with and pressingly inserted into the press-fitting parts 221*a* of the accommodation parts 221 of the body, whereby the contacts 100 are accommodated in the accommodation parts 221.

Then, the shutters 300 are aligned with the main body hole parts 224*a* of the mounting holes 224 of the guide parts 220 of the body 200 and inserted thereinto from the tip face of the shutter main body 310 of the shutter 300. After the insertion of the shutter 300, their first runner parts 320 are fitted in the main body hole parts 224*a* of the mounting holes 224, and their second runner parts 330 are fitted in the guide dented parts 224*b* of the mounting holes 224.

Then, the pairs of piece members 430 of the operation members 400 are aligned with the pairs of openings 225 of the guide parts 220 of the body 200, and are inserted thereinto in a manner not contacting the first and second bent parts 111*a* and 112*a* of the contacts 100 inside the accommodation parts 221. Then, in a state where the shutters 300 are positioned at the closing position, the operation members 400 are pressed against the guide parts 220 of the body 200, whereby the respective opposite widthwise ends of the operation members 400 are elastically deformed, and go over the guide protrusions 223 of the guide parts 220. Thereby, the guide protrusions 223 of the guide parts 220 are fitted in the rail grooves 420 of the operation members 400. At the same time, the third runner parts 340 of the shutters 300 are fitted in the hole parts 442 of the guide grooves 440 of the operation members 400.

Hereinafter, description will be made of how to use the connecting device assembled in the above procedures. First, the engaging claws 214 of the body 200 are inserted into and engaged with engaging holes, not shown, of the substrate 20. Then, the second connection parts 120 of the contacts 100, protruding from the open part 213 of the body 200, are pressed against and make elastic contact with a circuit pattern, not shown, of the substrate 20. Thereby, the contacts 100 are electrically connected with the circuit pattern of the substrate 20.

Then, the operation members 400 are moved from the initial positions to the pressed positions. At this time in each operation member 400, the engaging piece 450 goes over the pair of engaging protrusions 226 of the corresponding guide part 220. Then, as shown in FIG. 4(*b*), one of the piece members 430 of the operation member 400 presses the two first bent parts 111*a* of the two first clamp arms 111 of the contact 100 inside the accommodation part 221, while the other piece member 430 presses the second bent part 112*a* of the second clamp arm 112 of the same contact 100. The pressing by the piece members 430 causes the two first bent parts 111*a* and the second bent part 112*a* to move in directions approaching each other, and concurrently causes the two first hold parts 111*b* and the second hold part 112*b* to move in directions approaching each other and intersect with each other, and then move in directions away from each other so as to form the space α between the two first hold parts 111*b* and the second hold part 112*b*.

At the same time, the third runner part 340 of the corresponding one of the shutter 300 is guided from the hole part 442 of the guide groove 440 of the operation member 400 to the inclined groove part 441 and thereby moves to the dented part 443, as shown in FIGS. 4(*a*), 4(*b*), 5(*a*) and 5(*b*). At this time, the first and second runner parts 320 and 330 of the shutter 300 move in the orthogonal direction, from one end to the other end of the mounting hole 224, while contacting the upper end face of the main body hole part 224*a* and the guide dented part 224*b* of the corresponding mounting hole 224 of the body 200. In this way, the shutter main body 310 of the shutter 300 moves from the closing position with the insertion opening 222 of the body 200 closed to the opening position to open the opening.

Then, the lamp part 11 of a cold cathode fluorescent lamp 10 is inserted into the corresponding accommodation groove 211 of the body 200, and the lead terminal 12 of the cold cathode fluorescent lamp 10 is inserted into the insertion opening 222 of the body 200 from the side. Thereby, the lead terminal 12 is guided into the slit 212*a* of the wall part 212 of the body 200, and is inserted into the space α formed between the two first hold parts 111*b* and the second hold part 112*b* of the contact 100 inside the accommodation part 221 of the body 200.

Then, the operation member 400 is moved from the pressed position to the initial position. The engaging piece 450 is brought into engagement with the engaging protrusions 226 of the corresponding guide part 220 and stops there. At this time, one of the piece members 430 of the operation member 400 releases the pressing force against the two first bent parts 111*a* of the two first clamp arms 111, while the other piece member 430 releases the pressing force against the second bent part 112*a* of the second clamp arm 112. Then, with return forces of the two first clamp arms 111 and the second clamp arm 112 themselves, the two first bent parts 111*a* and the second bent part 112*a* move in directions away from each other, and the two first hold parts 111*b* and the second hold part 112*b* move in directions approaching each other. The movement of the clamp arms causes the space α to close, and the lead terminal 12 inserted in the space α is held among the first hold parts 111*b* and the second hold part 112*b*. In this way, the lead terminal 12 is electrically connected with the contact 100.

In the meantime, the third runner part 340 of the corresponding shutter 300 is guided from the dented part 443 of the guide groove 440 of the operation member 400 to the inclined groove part 441 to thereby move to the hole part 442, as shown in FIGS. 4(*b*), 4(*c*), 5(*b*) and 5(*c*). At this time, the first and second runner parts 320 and 330 of the shutter 300 move in the orthogonal direction, from the other end to the one end of the mounting hole 224, while contacting the lower end faces of the main body hole part 224*a* and the guide dented part 224*b* of the mounting hole 224 of the body 200. In this way, the shutter main body 310 of the shutter 300 moves from the opening position with the insertion opening 222 of the body 200 open to the closing position to close the opening.

To remove the lead terminal 12, the operation member 400 is again moved from the initial position to the pressed position. At this time, the engaging piece 450 of the operation member 400 goes over the engaging protrusion parts 226 of the guide part 220. Then, the one of piece member 430 of the operation member 400 presses the two first bent parts 111*a* of the two first clamp arms 111 of the contact 100, while the other piece member 430 presses the second bent part 112*a* of the second clamp arm 112. The pressing by the piece members causes the two first bent parts 111*a* and the second bent part 112*a* to move in directions approaching each other, and concurrently causes the two first hold parts 111*b* and the second hold part 112*b* to move in directions away from each other. The movement of the clamp arms increases the space α so as to release the holding of the lead terminal 12 by the two first hold parts 111*b* and the second hold part 112*b*.

In the meantime, as shown in FIGS. 4(*c*), 4(*b*), 5(*c*) and 5(*b*), the third runner part 340 of the corresponding shutter 300 is guided from the hole part 442 of the guide groove 440 of the operation member 400 to the inclined groove part 441 to thereby move to the dented part 443. At this time, the first and second runner parts 320 and 330 of the shutter 300 move from one end to the other end of the mounting hole 224 in the orthogonal direction, while contacting the upper end faces of the main body hole part 224*a* and the guide dented part 224*b* of the mounting hole 224 of the body 200. In this way, the shutter main body 310 of the shutter 300 moves from the closing position with the insertion opening 222 of the body 200 closed to the opening position to open the opening.

Then, the lead terminal 12 is pulled out of the insertion opening 222 of the body 200.

In a connecting device as describe above, the insertion opening 222 of the body 200 can be closed with the shutter 300, whereby invasion of dust can be prevented. Therefore, conducting failure and short circuit of the contact 100 due to dust can be prevented.

Moreover, In the simple slide-operation of the operation member 400, holding/releasing of the lead terminal 12 by the first and second clamp arms 111 and 112 of the contact 100 and opening/closing of the shutter 300 can be performed simultaneously. Therefore, the shutter 300 will not hinder the insertion/removal of the lead terminal 12, and there is no need to perform an operation to open/close the shutter 300 separately from the holding/releasing operation of the lead terminal 12. Therefore, even though the shutter 300 is provided for preventing dust, mounting/removal of the lead terminal 12 can be performed easily, so replacement of the cold cathode fluorescent lamp 10 can be performed easily.

When each operation member 400 is moved to the pressed position, its piece members 430 press the first and second clamp arms 111 and 112 in such a manner that a space ax to insert the lead terminal 12 is formed between the two first hold parts 111*b* and the second hold part 112*b*. Then, when the operation member 400 is moved back to the initial position and releases the pressing by the piece members 430 so as to close the space α, the lead terminal 12 is held between the two first hold parts 111*b* and the second hold part 112*b*. Therefore, a load due to the elastic forces of the first and second clamp arms 111 and 112 will not be applied to the body 200, so the connecting device of the invention is suitable for use in a long period of time. Further, the lead terminal 12 can be mounted to the device simply by inserting the lead terminal 12 in the space α between the two first hold parts 111*b* and the second hold part and clamping the lead terminal 12 between the first hold parts 111*b* and the second hold part 112*b*, so it is not needed to press the lead terminal 12 against the contact 100 so as to form an accommodation space for accommodating the lead terminal 12 like the conventional examples. Therefore, it is possible to prevent breakage of the cold cathode fluorescent lamp 10 at the time of mounting, which may be caused by the load due to the pressing.

Further, by engaging the engaging claws 214 of the body 200 with the engaging holes of the substrate 20, the second connection parts 120 of the contacts 100 protruding from the open part 213 of the body 200 are made to elastically contact the circuit pattern of the substrate 20. Therefore, the contact 100 can be connected with the substrate 20 easily without using soldering connection, which will result in cost reduction.

Any design change can be made to the connecting device described above, as long as the device includes: a body having an insertion opening for removably receiving a lead terminal from a side; a contact to be accommodated inside the body and be contactable with the lead terminal inserted from the insertion opening; and a shutter provided with the body so as openably close the insertion opening.

Figure 9:
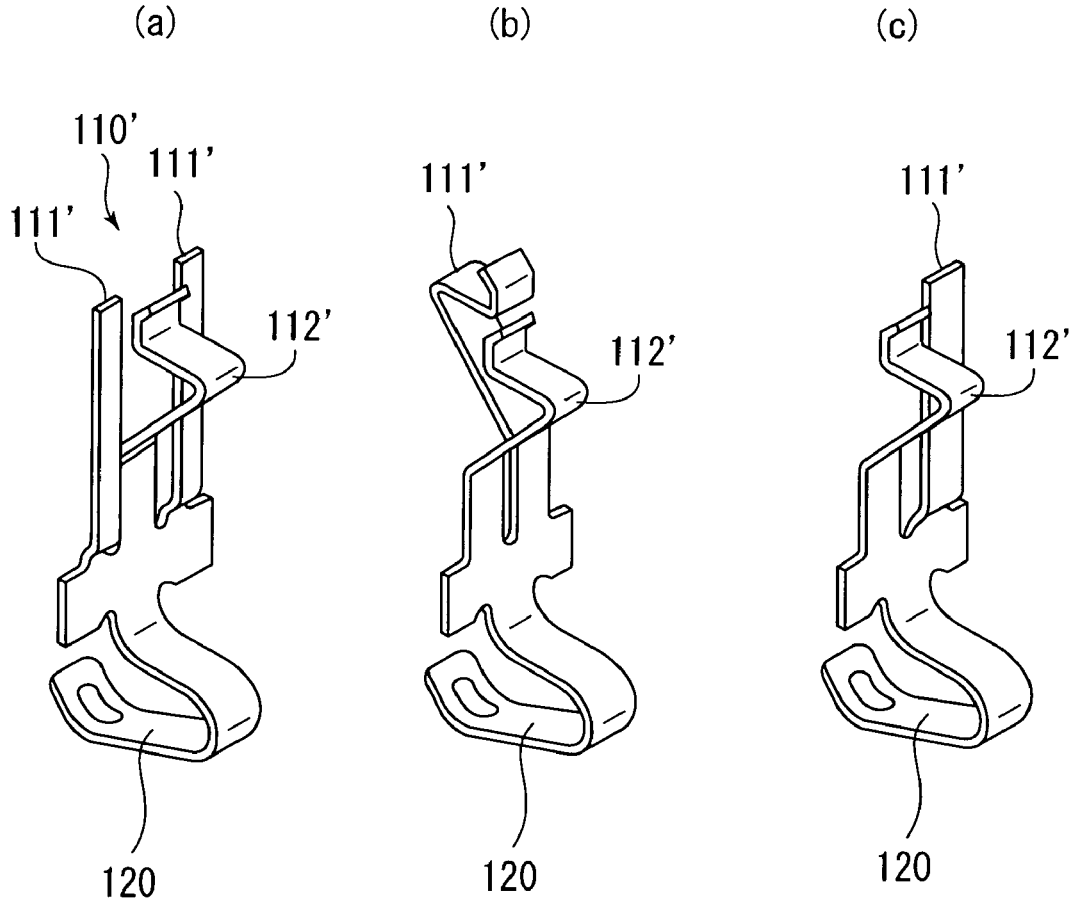
FIG. 9 is a schematic perspective view showing design modification examples of the contact of the device, in which (a) is a diagram of a contact having two first clamp arms which are fixed pieces, and a second clamp arm which is a movable piece, (b) is a diagram of a contact having first and second clamp arms which are movable pieces, and (c) is a schematic perspective view of a contact having a first clamp arm which is a fixed piece and a second clamp arm which is a movable piece.

Any design change may be made to the first connection part 110 of the contact 100, as long as the part includes at least two clamp arms, at least one of which is a movable piece, and when a bent part of the movable piece(s) is press-operated, a hold part of the movable piece moves in a direction approaching the other clamp arm so that they intersect with each other to form a space between them for receiving a lead terminal. For example, as shown in FIG. 9(*a*), the first connection part may include two first clamp arms 111' which are plate-shaped fixed pieces, and a second clamp arm 112' which is elastically deformable movable piece disposed between them, or, although not shown in the drawings, the first connection part may include two first clamp arms which are elastically deformable movable pieces and a second clamp arm which is a plate-shaped fixed piece disposed between them. By holding the lead terminal 12 at three points as described above, it can be held stably. However, it may be held at two points like a configuration including a pair of first and second clamp arms 111' and 112' which are elastically deformable movable pieces as shown in FIG. 9(*b*), or a configuration including a plate-shaped first clamp arm 111' which is a fixed piece and a second clamp arm 112' which is an elastically deformable movable piece as shown in FIG. 9(*c*). It is needless to say that a contact may have four or more clamp arms.

The first and second bent parts 111*a* and 112*a* and the first and second hold parts 111*b* and 112*b* may be in a curved shape. For the first and second bent parts 111*a* and 112*a* and hold parts 111*b* and 112*b*, bent-shaped ones and curved-shaped ones may be combined.

Figure 10:
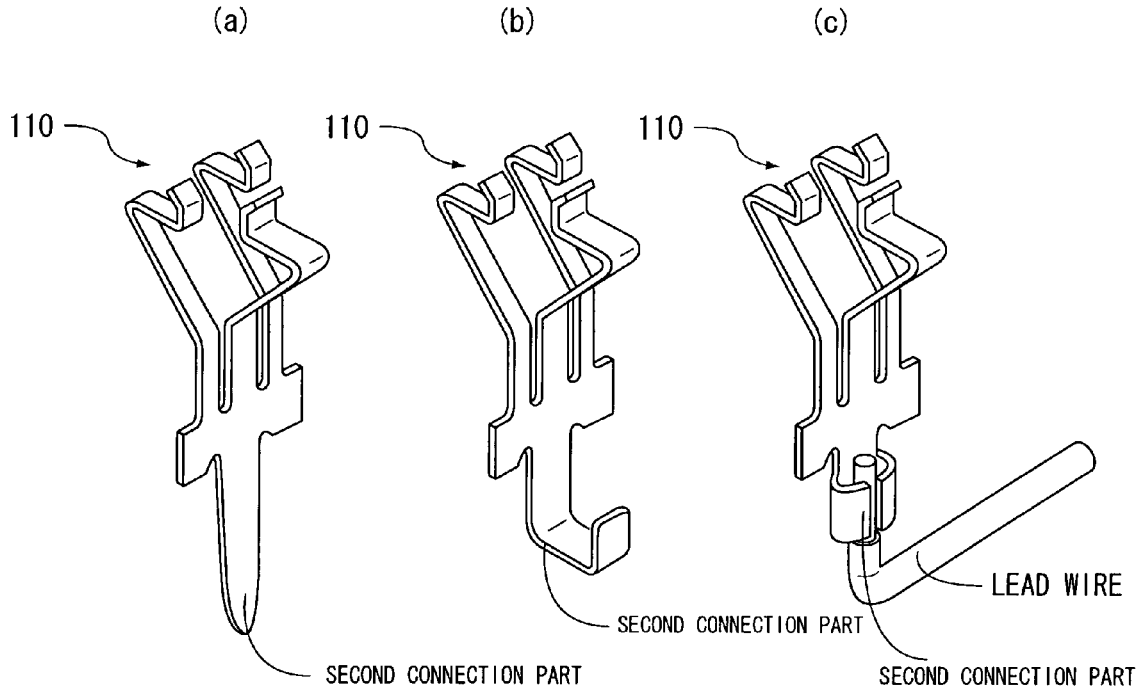
FIG. 10 is a schematic perspective view showing other design modification examples of the contact of the device, in which (a) shows a second connection part which is a plate-shaped body to be inserted into a through hole of a substrate, (b) shows a second connection part which is in a hooked shape to be mounted on a substrate, and (c) shows a second connection part in a shape to allow press-contacting a lead wire therewith.
Figure 11:
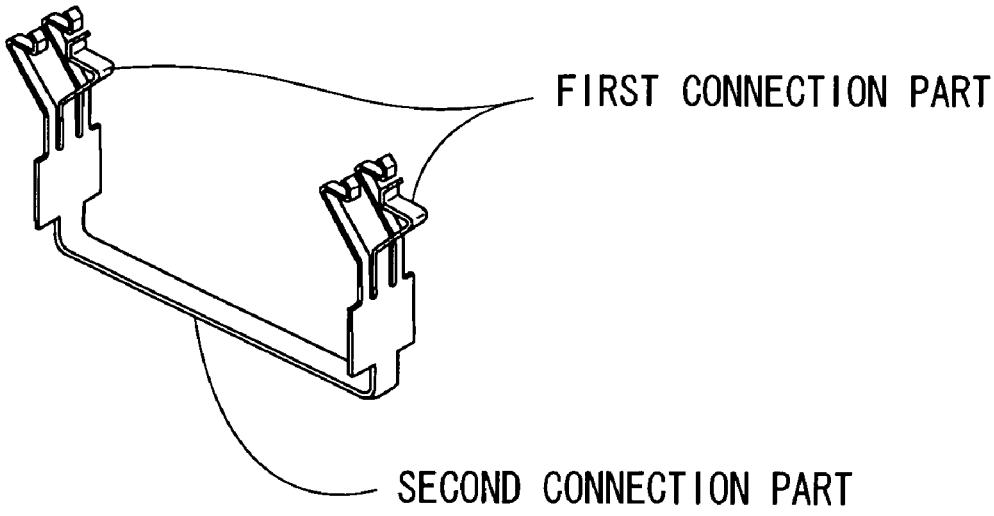
FIG. 11 is a schematic exploded perspective view showing still another design modification example of the contact of the device.

Any design change may be made to the second connection part 120 of the contact 100, as long as it can be electrically connected with the substrate 20. For example, if a through hole is formed in the substrate 20, the second connection part may be a straight plate-shaped body to allow insertion into the through hole as shown in FIG. 10(*a*), or may be a hook-shaped body which is contactable with the circuit pattern of the substrate 20 and is mountable on the substrate 20 as shown in FIG. 10(*b*). As shown in FIG. 10(*c*), the second connection part may be in a shape to allow a lead wire for connection with the circuit pattern of the substrate 20 or other electronic components to be press-connected to the second connection part. Alternatively, the second connection part 120 may be provided as a separate body to contact with the first connection part 120. As shown in FIG. 11, the second connection part may form a dented shape in a side view, and its respective end parts are provided with the first connection parts.

Figure 12:
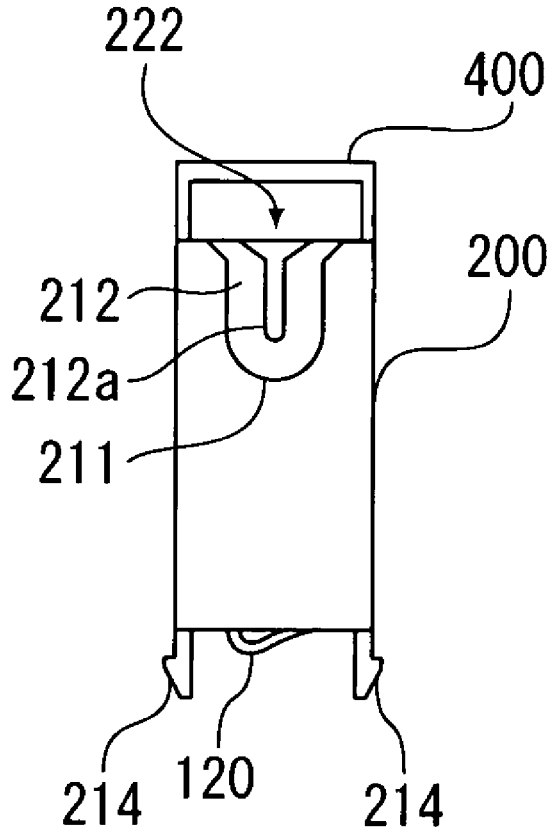
FIG. 12 is a schematic front view showing a design modification example of the body of the device.

Any design change may be made to the body 200, as long as it can accommodate the contact. Accordingly, although the embodiment described above discloses a body accommodating two contacts 100, the body needs to accommodate at least one contact, as shown in FIG. 12.

Any type and any number of engaging claws 214 of the body 200 may be used as long as they are provided on an edge (or edges) of the open part 213 of the body 200, extend in the protruding direction of the second connection part 120 and is engageable with the substrate 20. Further, although the engaging claws 214 has been described to engage with the engaging holes of the substrate 20, they may engage with ends or grooves of the substrate 20, or with other components provided on the substrate 20. Alternatively, engaging claws may be formed on the substrate 20, and the body has engaged parts instead, with which the engaging claw are engaged.

Any design change is acceptable to a mounting holes 224 of the body 200 as long as it is a long hole or a long groove (to be described in detail later) provided below or above the insertion opening 222 and extends in a direction almost orthogonal to the insertion/removal, for guiding the shutter 300 from the opening position to the closing position. If the mounting hole is formed above the insertion opening, on the edge of the insertion opening there may be provided a wall in which the mounting hole is formed.

Any kind of shutter 300 may be used as long as it can open and close the insertion opening of the body. Further, the first runner part 320 of the shutter 300 may be in any shape as long as it is movable in the orthogonal direction in the mounting hole of the body. The second runner part 330 of the shutter 300 may not be omitted if the first runner part 320 is movable stably in the mounting hole by only itself. The third runner part 340 of the shutter 300 may be in any shape if it fits in the guide groove 440 of the operation member 400 movably.

Any design change can be made to an operation member 400 if it is provided movably on the body in an insertion/removal direction and has a guide groove obliquely crossing the mounting hole. For example, the operation member may be formed inside the accommodation part 221 of the body 200. In such a case, the guide groove of the operation member penetrates the operation member, and the mounting hole is formed as a long groove in the face facing the operation member of the body. Note that it is also possible to form both of the guide groove and the mounting hole as through holes.

Further, in the case where the operation member is formed as an operation member dedicated for operating a shutter, there may be provided a separate operation member for pressing the first and second bent parts 111*a* and 112*a*. For example, the body 200 may have an opening in a part above the first and second bent parts 111*a* and 112*a*, and an operation member 400 in a rod shape may be inserted in the opening so as to press the first and second bent parts 111*a* and 112*a*. It is not impossible to expose the first and second bent parts 111*a* and 112*a* from the both end parts of the body 200 for manual operation.

Any type of piece member 430 of the operation member 400 may be used if it can press the first and second bent parts 111*a* and 112*a*.

Lastly, although the connecting device of the invention has been described as a socket for a cold cathode fluorescent lamp, it is not limited to this. It is needless to say that the present invention is applicable to any other connecting devices such as connectors for electrically connecting a lead terminal and a substrate.

What is claimed is:

1. A connecting device, comprising:

a body having an insertion opening for removably receiving a lead terminal from a side thereof;

a contact to be accommodated inside the body, the contact being contactable with the lead terminal inserted into the body through the insertion opening;

a shutter provided in the body so as to openably close the insertion opening; and an operating member mounted on the body for operating the shutter, said operating member being movable in an insertion/removal direction of the lead terminal, wherein said shutter is engageable with a guide groove provided on said operating member, said guide groove being oblique to the movement axis of the operating member, such that said shutter is caused to move in said guide groove for opening and closing the insertion opening in response to movement of the operating member.

2. A connecting device, comprising a body having an insertion opening for removably receiving a lead terminal from a side thereof;

a contact to be accommodated inside the body, the contact being contactable with the lead terminal inserted into the body through the insertion opening;

a shutter provided with the body so as to openably close the insertion opening; and an operation member mounted on the body movably in an insertion/removal direction of the lead terminal, adapted for operation to move at least the shutter, wherein the body is provided with a mounting hole comprising a long hole extending in a direction substantially orthogonal to the insertion/removal direction of the lead terminal and penetrating the body, the operation member has a guide groove in a face thereof facing the body, the guide groove obliquely crossing the mounting hole and fitting the shutter thereinto through the mounting hole, and the shutter is adapted to move from one end portion of the guide groove to the other end portion of the guide groove in accordance with a movement of the operation member and thereby move in the mounting hole from an opening position to open the insertion opening to a closing position to close the insertion opening.

3. The connecting device according to claim 2, wherein the contact includes a first connection part for connection with a lead terminal and a second connection part for connection with a substrate, the first connection part includes a first clamp arm comprising a fixed piece and a second clamp arm comprising an elastically deformable movable piece, the second clamp arm includes:

a bent or curved part which is bent or curved in a direction away from the first clamp arm, and a hold part which is continued from a tip portion of the bent or curved part and is bent or curved in a direction opposite to the bent or curved part, a face of the body facing the operating member has an opening, the opening being arranged to face the bent or curved part, the operation member has a piece member to be inserted in the opening movably in the insertion/removal direction, the piece member is adapted to press the bent or curved part toward the first clamp arm when the shutter is positioned at the opening position, and to release the pressing of the bent or curved part when the shutter is positioned at the closing position, and when the bent or curved part is pressed by the piece member, the hold part moves in a direction approaching the first clamp arm and crosses the first clamp arm so as to form a space for receiving the lead terminal between the hold part and the first clamp arm, and when the pressing by the piece member is released, the hold part moves in a direction approaching the first clamp arm and close the space so as to hold the lead terminal between the hold part of the second clamp arm and first clamp arm.

4. The connecting device according to claim 3, wherein the second clamp arm comprises two second clamp arms and are provided on both sides of the first clamp arm.

5. The connecting device according to claim 2, wherein the contact includes a first connection part for connection with a lead terminal and a second connection part for connection with a substrate, the first connection part has first and second clamp arms which are elastically deformable, the first and second clamp arms including:

first and second bent or curved parts which are bent or curved in directions away from each other; and first and second hold parts which are continued from tip portions of the first and second bent or curved pans, and are bent or curved in directions opposite to the first and second bent or curved parts, a face of the body facing the operating member has an opening, the opening being arranged to face the first and second bent or curved parts, the operation member has a pair of piece members to be inserted in the opening movably in the insertion/removal direction, the pair of piece members are adapted to press the first and second bent or curved parts in directions approaching each other when the shutter is positioned at the opening position, and to release the pressing of the first and second bent or curved parts when the shutter is positioned at the closing position, and when the first and second bent or curved parts are pressed by the pair of piece members, the first and second hold parts move in directions approaching each other and cross each other so as to form a space for receiving the lead terminal between the first and second hold parts, and when the pressing by the pair of piece members is released, the first and second hold parts move in directions approaching each other and close the space so as to hold the lead terminal between the first and second hold parts.

6. The connecting device according to claim 5 or 3, wherein the first clamp arm comprises two first clamp arms and are provided on both sides of the second clamp arm.

7. The connecting device according to claim 5 or 3, wherein the body further comprises:

an open part for protruding the second connection part of the contact so as to be contactable with a circuit pattern of the substrate, and an engaging claw being provided on an edge portion of the open part and extending in a protruding direction of the second connection part for engagement with the substrate.

8. The connecting device according to claim 7, wherein the second connection part of the contact is in a shape to allow elastic contact with the circuit pattern of the substrate.

9. The connecting device according to claim 7, wherein the second connection part of the contact is in a substantially straight shape to allow insertion into a through hole of the substrate.

10. The connecting device according to claim 7, wherein the second connection part of the contact is in a shape to allow press-contact of a lead wire therewith.

* * * * *